US007481693B2

(12) United States Patent
Arnau Manresa

(10) Patent No.: US 7,481,693 B2
(45) Date of Patent: Jan. 27, 2009

(54) DYNAMIC CURRENT COLLECTOR SYSTEM FOR A SET OF TOY VEHICLES WHICH ARE DISPOSED ON A TRACK COMPRISING A GUIDE GROOVE

(75) Inventor: Luis Maria Arnau Manresa, Barcelona (ES)

(73) Assignee: Winkler International, SA, Luxembourg (LU)

( * ) Notice: Subject to any disclaimer, the term of this patent is extended or adjusted under 35 U.S.C. 154(b) by 508 days.

(21) Appl. No.: 10/532,225

(22) PCT Filed: Oct. 22, 2003

(86) PCT No.: PCT/ES03/00536

§ 371 (c)(1),
(2), (4) Date: Sep. 13, 2005

(87) PCT Pub. No.: WO2004/037364

PCT Pub. Date: May 6, 2004

(65) Prior Publication Data

US 2006/0128266 A1 Jun. 15, 2006

(30) Foreign Application Priority Data

Oct. 22, 2002 (ES) ..... 200202500

(51) Int. Cl.
*A63H 17/14* (2006.01)

(52) U.S. Cl. ..... 446/433; 446/455; 104/305

(58) Field of Classification Search ..... 446/443, 446/441, 444–445, 456; 238/10 F, 10 R; 104/140, 142, 305
See application file for complete search history.

(56) References Cited

U.S. PATENT DOCUMENTS 3,422,770 A * 1/1969 Celesia ..... 463/62
4,697,812 A * 10/1987 Rudell et al. ..... 104/305
5,218,909 A * 6/1993 Ng ..... 104/60

FOREIGN PATENT DOCUMENTS

DE 876976 5/1953
DE 878316 6/1953

* cited by examiner

*Primary Examiner*—John M Hotaling
*Assistant Examiner*—Alex F. R. P. Rada, II
(74) *Attorney, Agent, or Firm*—Nixon & Vanderhye P.C.

(57) ABSTRACT

A dynamic current collector system for a set of toy vehicles disposed on a track. The system includes electroconductive tracks which can be connected to a power supply unit and which are disposed along inner sides of a guide groove. The system also includes current collector elements which are electrically connected to a motor of the vehicle and which are positioned on outer lateral faces of a guide follower flange disposed at a lower front part of the vehicle. The electroconductive tracks are concealed inside the groove. When the vehicle moves along the track with the flange inserted in the guide groove, a dynamic electrical contact is established between the tracks and the current collector elements to supply current to a motor that powers the vehicle.

27 Claims, 2 Drawing Sheets

DYNAMIC CURRENT COLLECTOR SYSTEM FOR A SET OF TOY VEHICLES WHICH ARE DISPOSED ON A TRACK COMPRISING A GUIDE GROOVE

The present invention refers to a dynamic current collector system for a set of toy vehicles which are disposed on a track comprising a guide groove, and more specifically, to a dynamic current collector system that allows to hide electroconductive tracks in a lower zone of said guide groove, in such a way that the electroconductive tracks are practically imperceptible from the outside and the guide groove is hidden.

It is well known in the state of the art, games of competition of miniature vehicles that move on a track in functions of tread surface, where the vehicles have in their lower front part a guide flange which goes comfortably inserted in a guide groove excavated in the track. The vehicles are equipped with an electrical motor that drives at least one driving wheel. A dynamic current collector system allows the vehicle to take current from electroconductive tracks placed in both sides of the guide groove by means of supply current elements, such as braids. The mentioned electroconductive tracks have a coplanar contact surface with the tread surface of the track and are adapted to be connected to an electrical power supply through control means placed for the player. The braids or contact elements are arranged in this frontal lower part of the vehicle, in both sides of the guide flange, and are connected to the motor. Although this configuration is technically operative, the presence of the mentioned electroconductive tracks in both sides of the guide groove is very evident and contrasts with the realistic appearance with which habitually are designed the rest of the track, the vehicles and other accessories. Often, in order to obtain the mentioned realistic appearance, a dark colour is provided to the tread surface of the track, as grey dark or black, in imitation of the asphalt, whereas the electroconductive tracks are metallic and usually they are very polished by effect of the friction of the braids. Therefore, the electroconductive tracks shine on apparent way on the dark track in both sides of the guide groove, spoiling the illusion of reality that the game tries to create.

As a consequence of a British Patent of the year 1956, which describes a game of a type similar to the above described, it is known a dynamic current collector system in which each one of the arranged electroconductive tracks in the track, in both sides of the groove, has a profile in shape of "L", with an arm substantially coplanar in respect to the tread surface and placed in an adjacent zone to the groove and the other arm substantially perpendicular to the surface tread and placed on an inner sidewall of the groove. On the other hand, the current collector elements of the vehicle are formed by a wheel placed in a revolving way in the lower front part of the vehicle and formed by two electroconductive portions in bell form, faced and joined by their wider sides in the central part, and isolated by a dielectric material, which are in electrical connection with the motor of the vehicle. In operating mode, these bell surfaces run rested over the respective edges of the electroconductive tracks in form of "L" and with the prominent central part fitted in the guide groove. Nevertheless, in this system, although a part of the tracks is hidden in the groove, another part is exposed in the upper part of the track and is well visible. In addition, the described wheel has deficiencies as far as its guide function, reason why this system has been left in benefit of the actual system with flange and braids.

Thus, it is known the U.S. Pat. No. 2,068,403, of 1936, in the name of A. L. EKSTROM, that refers to a toy apparatus that comprises a vehicle moved by itself, a track with a central groove defined in it, a direction manager mechanism for said vehicle that comprises an element that is adapted to couple with said groove, said track being as wide as to allow a path for the vehicle in the tread surface.

Also it is known the German Patent No. 878316, of 1949, in the name of Werner Diekhoff, that refers to a toy electric vehicle, as for example a car which direction element over the track moves through a groove, placed in the inner part of a path an inclined parallelogram that is a part of the front wheels mechanism and the direction channel.

Lastly, it is a part of the state of the art the German Patent No. 876976 that comprises a guided toy, electrically feed, with transporting jeans connected for the transmission of the information of the users to the control element, which is in a groove, in the track, under the laterals, by means of spring action.

The objective of the present invention is to give a dynamic current collector system for a set of toy vehicles which are disposed on a track comprising a guide groove in which the electroconductive tracks are substantially hidden and are practically imperceptible from the outside of the track.

This objective is obtained, in agreement with the present invention, contributing a dynamic current collector system in which the electroconductive tracks are hidden in an inner lateral zone of said guide groove and the current collector elements of the vehicle are placed in the laterals of that part of the guide follower flange which is introduced into the groove. With it, the electroconductive tracks are practically imperceptible from the outside and the guide groove, when the colour of the tread surface is dark, is disguised. With this improvement it is highly increased the realistic appearance of the game.

These and other characteristics and advantages will be understood much better from the following detailed description of an embodiment with reference to the attached drawings, in which.

Figure 1:
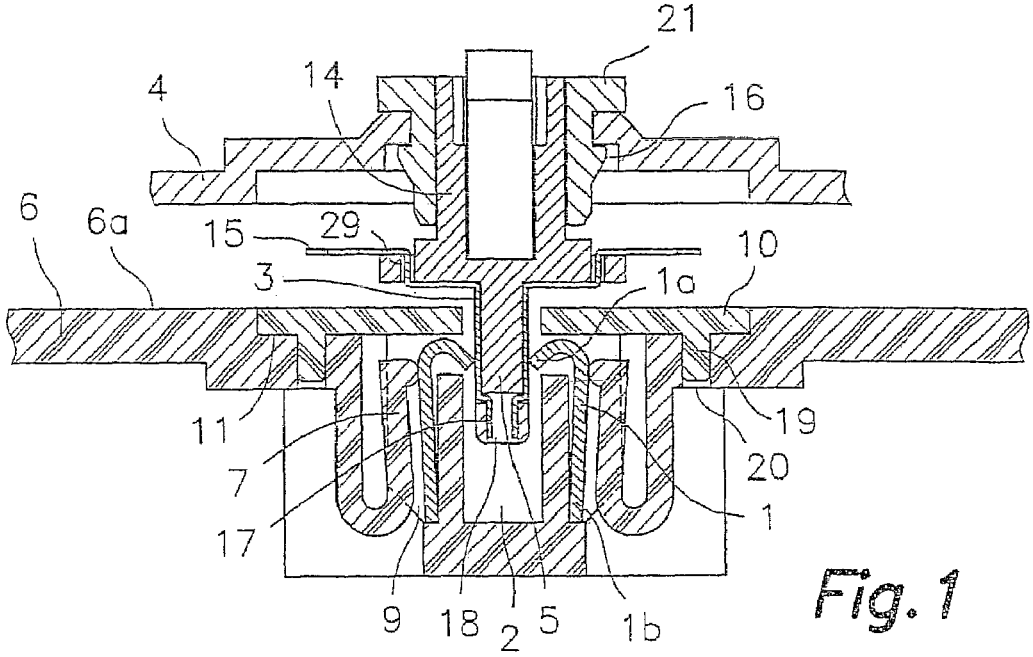
FIG. 1 is a cross-sectional section view of the main elements that constitute the system of the present invention.

First of all, referring to the FIG. 1, the dynamic current collector system for a set of toy vehicles which are disposed on a track comprising a guide groove of the present invention comprises a track 6 that includes a tread surface 6*a* for toy vehicles, in miniature, as they are driven by at least an electrical motor (not shown) placed in the same vehicle and arranged to drive at least a driving wheel. In the tread surface 6*a* opens a guide groove 2 and the vehicle includes, in its lower front part 4, a guide flange 5 which is inserted in said groove 2. The depth of insertion of the flange 5 in the groove 2 is limited by the front wheels of the vehicle (not shown) which leans and rolls over the tread surface 6*a* of the track 6, which also contributes to the realistic appearance of the game. Placed in both sides of the guide groove 2 there are electroconductive tracks 1, conectables to a power supply (not shown), and the electrical vehicle includes current collector elements 3 connected to said electrical motor and placed in both sides of said guide follower flange 5. Electroconductive tracks 1 are arranged throughout the lateral interiors of the guide groove 2 and the current collector elements 3 are located in outer lateral faces of said guide follower flange 5. The vehicle, impelled by said electrical motor, is capable of moving by the mentioned track 6 following said guide groove 2 while an electrical contact between these electroconductive tracks 1 takes place and said current collector elements 3 to provide electrical current to the motor. Typically, track 6 has two or more guide grooves 2 to other so many vehicles, and each player has control means to control the tension which the electroconductive tracks 1 are fed, associated to the groove 2 by which its vehicle runs in order to regulate the speed.

The current collector elements 3 are made of a laminar material and are leaned to these outer lateral faces of the guide follower flange 5 (see also FIGS. 2 and 3) whereas electroconductive tracks 1 are pushed by the force of elastic elements 7 towards a central zone of the guide groove 2, in such a way that, when the vehicle crosses, the current collector elements 3 make contact with the electroconductive tracks 1 separating them against said force of the mentioned elastic elements 7. Electroconductive tracks 1 are preferably made of a laminar material and have, as a contact zone, a rim or an edge 1*a* of a portion of said laminar material not parallel to the respective current collector elements 3. So, the contact is concentrated in a point, which improves the pass of the current. Advantageously, said portion of laminar material not parallel to the current collector elements 3 is inclined downwards and towards the center of the guide groove 2, so that the inclined portions of the two faced electroconductive tracks 1 form something like a flexible funnel that improves the entrance of the guide follower flange 5 under a slight pressure.

Figure 2:
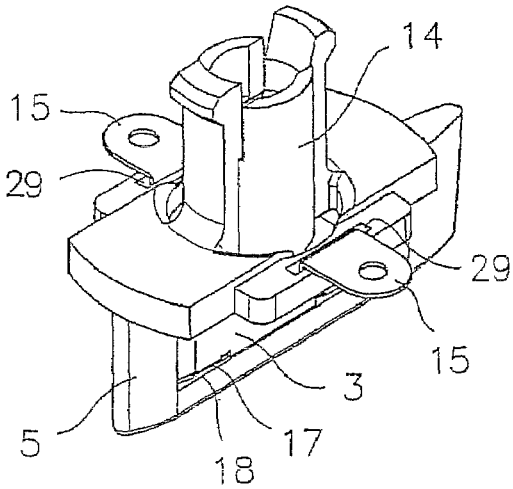
FIGS. 2 and 3 are views in upper and lower perspective of three quarters, respectively of the guide follower flange with current collector elements of the FIG. 1.
Figure 3:
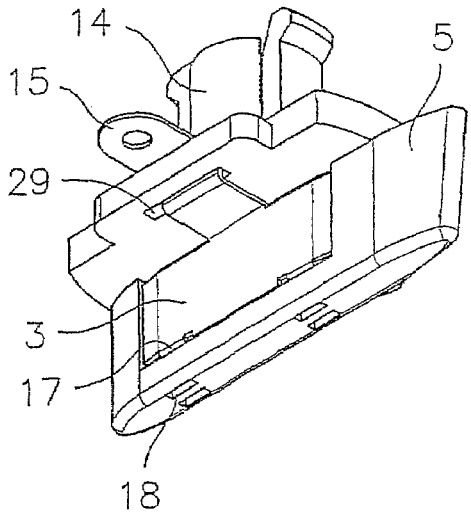

As it is shown in FIGS. 1, 2 and 3, the guide follower flange 5 is integral of a rod 14 inserted in such a way that it can turn in a hole 16 of lower front part 4 of the vehicle, optionally through a collar 21, and the current collector elements 3 extend superiorly in terminals 15 of connection to conductive elements connected to the motor of the vehicle, such as flexible cables. In order to provide a safe subjection, the current collector elements 3 have, for example, in the lower part forks 17 inserted in one or more cavities 18 of the flange 5, and said terminals 15 are passed through gaps 29 in the foot of the rod 14 and folded.

Alternatively, the rod 14 could allow a substantial axial movement and terminals 15 could be designed in form of flat surfaces (not shown) on which made dynamic contact, laminar electroconductive elements, elastic, connected to the motor, in a way included in the state of the art.

Figure 4:
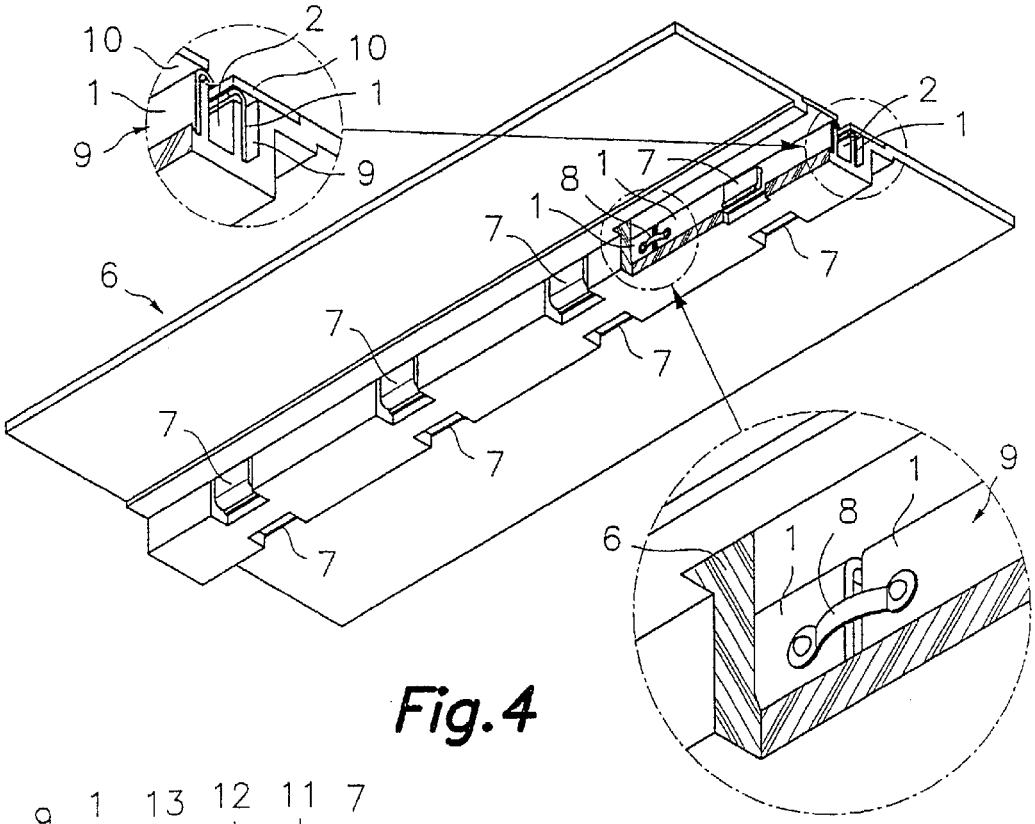
FIG. 4 is a lower perspective view of three quarters, partially sectioned, of a track element in agreement with the system of the invention, including extended detailed views that show an end of the groove and a connection element, respectively.

As it is shown in the FIG. 4, in each guide groove 2 of a track 6, electroconductive tracks 1 are formed by a plurality of separated, adjacent sections, electrically connected to each other by flexible connection elements 8. For this reason, the track 6 comprises longitudinal cavities 9 placed in both sides of the guide groove 2 and parallel to the same one. The sections of the electroconductive track 1 have a folded portion 1*b* introduced in said longitudinal cavities 9 so that the contact rims or edges 1*a* are inside of the guide groove 2. Longitudinal cavities 9 define a narrowed bottom in which lower edges of this folded portion 1*b* lean, of the sections of electroconductive track 1, so that these ones can pivot on these lower edges. The mentioned elastic elements are arranged throughout longitudinal cavities 9 so that each section of electroconductive track 1 is pushed by at least one of these elastic elements 7. With it, when the current collector elements located in the flange of the vehicle press against the electroconductive tracks 1, only the sections of track 1 that are pressed pivot against the force of the elastic elements 7 applied over them. In the curved tracks (not shown), the sections of electroconductive track are short and numerous, and the more closed it is the curve, the more short and numerous they have to be in order to provide a uniform movement of the vehicle.

In the embodiment example of the FIG. 4, the track 6 is made of a dielectric material and fully defines the tread surface 6*a* for the vehicles, the longitudinal guide groove 2, and cavities 9. Advantageously, elastic elements 7 are in the form of elastic tongue-pieces 7 integrals of the track 6 (it also seen in the FIG. 1). Each one of the mentioned flexible connection elements 8, better shown in the extended detail of the FIG. 4, are constituted by a bridge of flexible electroconductive material, as metallic sheet or a cable, finished in their ends by terminals connected respectively, for example, by weld, to the ends of each one of the two different adjacent sections of the electroconductive track 1. Other similar flexible connection elements can be used, not shown, for the connection of two of the sections of track 1 located in the opposed sides of the groove 2 to a connectable terminal to the power supply, or to connect the final sections of a track 6 to a terminals of conventional connection to plug (not shown) for joint with the track of another element of adjacent view.

Figure 5:
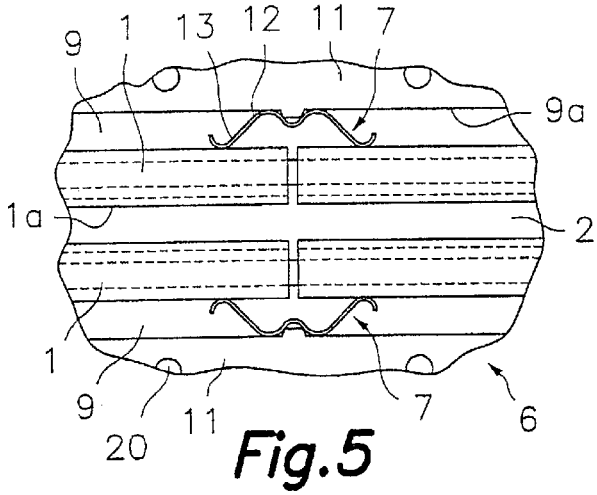
FIG. 5 is a partial detailed upper elevational view, without the covers, that shows an alternative example of embodiment for the connection element.

According to an alternative example of embodiment in the FIG. 5, elastic elements 7 are in the form of sheets 12, of an electroconductive material, inserted between a back wall 9*a* of the longitudinal cavities 9 and electroconductive tracks 1. Mentioned sheets have in their ends elastic forks 13 leaned against the back parts of two different adjacent electroconductive tracks 1, reason why, besides to make the wished elastic function, they act like flexible connection elements in order to electrically connect the adjacent tracks 1 replacing the bridges shown in the FIG. 4.

Figure 6:
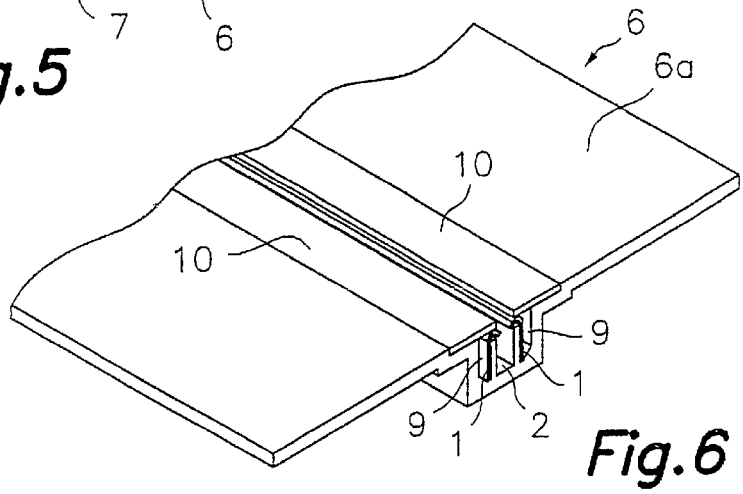
FIG. 6 is a perspective view of three upper quarters of the track element of the FIG. 4.

As it is shown in FIG. 6, and also in FIGS. 1 and 4, the electroconductive tracks 1 are kept in longitudinal cavities 9 and upper covered by longitudinal covers 10, of dielectric material, which are housed in recesses 11 foreseen in both sides of the guide groove 2 and fixed, for example, by means of integral projections 19 of the lower face of the covers 10 inserted in holes 20 placed in said recesses 11. The thickness of covers 10 is equal to the depth of the recesses 11, so that a superior surface of these longitudinal covers 10 is levelled off with said tread surface 6*a* of the track 6 and opposed edges of longitudinal covers 10 define an opening for the guide groove 2. Preferably, the mentioned longitudinal covers 10 are made of the same material, colour and surface finish than the rest of the tread surface 6*a* of track 6, hiding at the maximum the existence of the guide groove 2 and, specially, of electroconductive tracks 1. If the colour of the tread surface 6*a* and longitudinal covers 10 is dark, for example, a dark gray, or black, to imitation of asphalt, the existence of the guide groove 2 and electroconductive tracks 1 can be practically unnoticed.

A skilled person could introduce numerous variations without leaving the scope of the present invention, which is defined by the following claims.

The invention claimed is:

1. A dynamic current collector system for a set of toy vehicles, the system comprising:

a track having at least one guide groove formed therein;

a plurality of electroconductive tracks positioned along opposite sides of the at least one guide groove; and a plurality of current collector elements positioned on opposite sides of a guide follower flange that is provided at a lower front portion of a vehicle and that extends into the at least one guide groove, wherein the plurality of electroconductive tracks are biased against the plurality of current collector elements by a plurality of elastic elements so as to provide for dynamic electrical contact between the plurality of electroconductive tracks and the plurality of current collector elements as the vehicle moves along the track with the guide follower flange positioned in the at least one guide groove.

2. The system of claim 1, wherein the guide follower flange is integrally formed at an end of a rod that is rotatably inserted in a hole of the lower front part of the vehicle, and the plurality of current collector elements are provided on an exterior surface of the guide follower flange so as to provide an electrical connection to the motor of the vehicle.

3. The system of claim 1, wherein a depth of insertion of the guide follower flange in the at least one guide groove is limited by a set of front wheels of the vehicle that lean and roll on a tread surface of the track.

4. The system of claim 1, wherein the plurality of current collector elements are joined to outer lateral faces of the guide follower flange, and wherein the plurality of electroconductive tracks are biased towards a central portion of the at least one guide groove by the plurality of elastic elements positioned along the at least one guide groove.

5. The system of claim 4, wherein pairs of electroconductive tracks positioned across from each other on corresponding opposite sides of a portion of the at least one guide groove are forced apart as the guide follower flange passes through the portion of the at least one guide groove, while the biasing force of the elastic members forces the pairs of electroconductive tracks back together so as to provide for contact between the plurality of current collector elements and the plurality of electroconductive tracks as the guide follower flange passes through the portion of the at least one guide groove.

6. The system of claim 4, wherein each of the plurality of electroconductive tracks comprises a laminar material with a contact zone having an edge portion thereof that is non-parallel to a respective current collector element.

7. The system of claim 6, wherein the contact zone is inclined downwards and towards the central portion of the at least one guide groove.

8. The system of claim 6, wherein the plurality of electroconductive tracks comprises a plurality of adjacent separated sections that are electrically connected to each other by flexible connection elements.

9. The system of claim 8, wherein the flexible connection elements each comprise a bridge of flexible electroconductive material having opposite end terminals respectively connected to the two different adjacent electroconductive tracks.

10. The system of claim 8, wherein the at least one guide groove comprises longitudinal cavities formed in opposite lateral sides thereof, wherein each of the plurality of electroconductive tracks has a leg portion that is positioned in a respective longitudinal cavity.

11. The system of claim 10, wherein an upper portion of the electroconductive track positioned in the longitudinal cavities is covered by longitudinal covers made of a dielectric material, wherein the longitudinal covers are coupled to recesses formed at an outside of opposite outer portions of the at least one guide groove so that an upper surface of the longitudinal covers is level with a tread surface of the track and opposite inner edges of the longitudinal covers define an opening for the at least one guide groove.

12. The system of claim 10, wherein each of the longitudinal cavities comprises a narrowed bottom that receives a lower edge of a respective electroconductive track such that the electroconductive tracks pivot on their lower edges as the electroconductive tracks are pushed by a respective elastic element positioned along the longitudinal cavities.

13. The system of claim 12, wherein the plurality of elastic elements comprise sheets of electroconductive material that are positioned between a back wall of the longitudinal cavities and the electroconductive tracks, wherein end portions of the sheets form elastic forks positioned against outer surfaces of two different adjacent electroconductive tracks so as to form flexible connection elements between the two different adjacent electroconductive tracks.

14. The system of claim 12, wherein an upper portion of the electroconductive track positioned in the longitudinal cavities is covered by longitudinal covers made of a dielectric material, wherein the longitudinal covers are coupled to recesses formed at an outside of opposite outer portions of the at least one guide groove so that an upper surface of the longitudinal covers is level with a tread surface of the track and opposite inner edges of the longitudinal covers define an opening for the at least one guide groove.

15. The system of claim 12, wherein the track is made of a dielectric material and integrally defines the guide groove, the longitudinal cavities and a tread surface for the vehicles.

16. The system of claim 15, wherein each of the plurality of elastic elements comprises an elastic tongue piece that is integrally formed with the track.

17. The system of claim 16, wherein an upper portion of the electroconductive track positioned in the longitudinal cavities is covered by longitudinal covers made of a dielectric material, wherein the longitudinal covers are coupled to recesses formed at an outside of opposite outer portions of the at least one guide groove so that an upper surface of the longitudinal covers is level with a tread surface of the track and opposite inner edges of the longitudinal covers define an opening for the at least one guide groove.

18. The system of claim 15, wherein each of the plurality of elastic elements comprises an elastic tongue that is separately formed from and coupled to the track.

19. The system of claim 18, wherein an upper portion of the electroconductive track positioned in the longitudinal cavities is covered by longitudinal covers made of a dielectric material, wherein the longitudinal covers are coupled to recesses formed at an outside of opposite outer portions of the at least one guide groove so that an upper surface of the longitudinal covers is level with a tread surface of the track and opposite inner edges of the longitudinal covers define an opening for the at least one guide groove.

20. The system of claim 15, wherein an upper portion of the electroconductive track positioned in the longitudinal cavities is covered by longitudinal covers made of a dielectric material, wherein the longitudinal covers are coupled to recesses formed at an outside of opposite outer portions of the at least one guide groove so that an upper surface of the longitudinal covers is level with a tread surface of the track and opposite inner edges of the longitudinal covers define an opening for the at least one guide groove.

21. A dynamic current collector system, comprising:

a track having a plurality of segments, each of the plurality of segments having at least one guide groove formed therein;

a plurality of electroconductive elements positioned along opposite vertical sides of the at least one guide groove;

at least one current collector element provided on an outer portion of a guide follower flange that extends downward into the at least one guide groove from a vehicle positioned on the track; and a plurality of elastic elements that bias the plurality of electro conductive elements toward a central portion of the at least one guide groove so as to bias a contact portion of each of the plurality of electroconductive elements towards the at least one current collector element as the vehicle moves along the track with the guide follower flange positioned in the at least one guide groove.

22. The system of claim 21, wherein the contact portion of each of the plurality of electroconductive elements extends downward at an incline from a top of the electroconductive element towards the central portion of the at least one guide groove, and at a different orientation that that of the at least one current collector element.

23. The system of claim 21, further comprising a plurality of flexible connection elements that connect electroconductive elements of adjacent track segments so as to form an electrical connection between the adjacent electroconductive elements.

24. The system of claim 21, further comprising longitudinal cavities that extend longitudinally along opposite lateral outside walls of the at least one guide groove, wherein a pivot end of each of the electroconductive elements is positioned within a respective longitudinal cavity such that the electroconductive elements pivot about their respective pivot ends as the vehicle moves along the track and the guide follower flange passes through a corresponding portion of the at least one guide groove.

25. The system of claim 24, wherein contact portions of a pair of electroconductive elements positioned on opposite sides of the at least one guide groove are forced apart as the guide follower flange passes through the corresponding portion of the at least one guide groove and the electroconductive elements pivot about their respective pivot ends, and the plurality of elastic elements biases the contact portions towards the central portion of the at least one guide groove so as to maintain contact between the plurality of electroconductive elements and the at least one current collector.

26. The system of claim 21, wherein the guide follower flange is integrally formed at an end of a rod that is rotatably inserted in a hole formed in a lower part of the vehicle so as to form an electrical connection with a motor of the vehicle, and wherein the at least one current collector element comprises a plurality of current collector elements positioned on an outer surface of the guide follower flange corresponding to the plurality of electroconductive elements.

27. The system of claim 21, further comprising a pair of longitudinal covers coupled to recesses formed at outer portions of the at least one guide groove so that an upper surface of the longitudinal covers is level with a tread surface of the track, and opposite inner edges of the pair of longitudinal covers define an entry into the at least one guide groove.

* * * * *